US012790694B2

(12) United States Patent
Jadhav et al.

(10) Patent No.: US 12,790,694 B2
(45) Date of Patent: Nov. 10, 2026

(54) Cr(III)-BASED PASSIVATION FOR ZINC-ALUMINUM COATED STEEL

(71) Applicant: Henkel AG & Co. KGaA, Duesseldorf (DE)

(72) Inventors: Aditi Jadhav, Purnanagar (IN); Meenu Vijay, Pune (IN); Niranjan Das, Pune (IN); Komal Wagh, Pune (IN)

(73) Assignee: Henkel AG & Co. KGaA, Duesseldorf (DE)

( * ) Notice: Subject to any disclaimer, the term of this patent is extended or adjusted under 35 U.S.C. 154(b) by 608 days.

(21) Appl. No.: 18/340,275

(22) Filed: Jun. 23, 2023

(65) Prior Publication Data

US 2023/0349048 A1 Nov. 2, 2023

Related U.S. Application Data

(63) Continuation of application No. PCT/EP2021/050133, filed on Jan. 6, 2021.

(51) Int. Cl.
*C23C 22/53* (2006.01)

(52) U.S. Cl.
CPC ..... *C23C 22/53* (2013.01); *C23C 2222/10* (2013.01)

(58) Field of Classification Search
None
See application file for complete search history.

(56) References Cited

U.S. PATENT DOCUMENTS

| | | | |
|---|---|---|---|
| 2,559,878 | A | 7/1951 | Johnson |
| 3,501,352 | A | 3/1970 | Shah |
| 3,647,569 | A | 3/1972 | Schneider |
| 3,676,398 | A | 7/1972 | D'Alelio |
| 3,700,643 | A | 10/1972 | Smith et al. |
| 3,770,602 | A | 11/1973 | D'Alelio |
| 3,905,929 | A | 9/1975 | Noll |
| 3,920,598 | A | 11/1975 | Reiff et al. |
| 3,932,198 | A | 1/1976 | Schneider |
| 4,018,851 | A | 4/1977 | Baccei |
| 4,072,529 | A | 2/1978 | Hoornstra et al. |
| 4,133,723 | A | 1/1979 | Howard |
| 4,188,455 | A | 2/1980 | Howard |
| 4,206,025 | A | 6/1980 | Vrancken et al. |
| 4,295,909 | A | 10/1981 | Baccei |
| 4,309,526 | A | 1/1982 | Baccei |
| 4,349,392 | A | 9/1982 | Huvar |
| 4,359,345 | A | 11/1982 | Da Fonte, Jr. |
| 4,359,346 | A | 11/1982 | Da Fonte, Jr. |
| 4,359,347 | A | 11/1982 | Da Fonte, Jr. |
| 4,359,348 | A | 11/1982 | Crotty |
| 4,367,099 | A | 1/1983 | Lash et al. |
| 4,380,613 | A | 4/1983 | Nativi |
| 4,439,600 | A | 3/1984 | Moran, Jr. |
| 4,511,732 | A | 4/1985 | Hicks |
| 4,574,138 | A | 3/1986 | Moran, Jr. et al. |
| 4,578,122 | A | 3/1986 | Crotty |
| 5,002,976 | A | 3/1991 | McConnell et al. |
| 5,378,291 | A | 1/1995 | Ara et al. |
| 5,743,971 | A | 4/1998 | Inoue et al. |
| 5,855,695 | A | 1/1999 | McMillen et al. |
| 6,447,620 | B1 | 9/2002 | Komiyama et al. |
| 11,643,732 | B2 * | 5/2023 | Inoue ..... C09D 5/08 428/472 |
| 2010/0180793 | A1 | 7/2010 | Dingwerth et al. |
| 2012/0091398 | A1 | 4/2012 | Hofmann et al. |
| 2014/0360630 | A1 | 12/2014 | Arnold et al. |

FOREIGN PATENT DOCUMENTS

| | | | |
|---|---|---|---|
| CN | 116783326 | A | 9/2023 |
| DE | 2338245 | A1 | 4/1975 |
| DE | 19733972 | A1 | 2/1999 |
| DE | 102007021364 | A1 | 11/2008 |
| DE | 102010001686 | A1 | 8/2011 |
| EP | 2617865 | A1 | 7/2013 |
| EP | 2785469 | B1 | 4/2018 |
| GB | 889050 | A | 2/1962 |
| GB | 1461244 | A | 1/1977 |
| WO | 2019219403 | A1 | 11/2019 |

OTHER PUBLICATIONS

International Search Report for PCT/EP2021/050133, mailed Oct. 7, 2021, 3 pages.

* cited by examiner

*Primary Examiner* — Keling Zhang
(74) *Attorney, Agent, or Firm* — Mary K. Cameron

(57) ABSTRACT

An aqueous passivation composition for the treatment of zinc or zinc alloy coatings, the aqueous passivation composition having a pH of from 6.5 to 9 and comprising, based on the weight of the aqueous passivation composition: a) at least one base polymer selected from acrylic polymers and non-ionic polyurethane polymers present in an amount of from 5 to at 60 wt. % of; b) trivalent Cr (II) ions, present in an amount of from 0.1 to 2.5 wt. %, calculated as Cr; c) ascorbic acid; d) least one aluminum compound present in an amount of from 0.1 to 2.5 wt. %; and, e) at least one finely divided wax present in the aqueous passivation composition in an amount of up to 10 wt. %; wherein the aqueous passivation composition is substantially free of nitrate anions and is substantially free of hexavalent chromium (Cr(VI)).

14 Claims, No Drawings

Cr(III)-BASED PASSIVATION FOR ZINC-ALUMINUM COATED STEEL

FIELD OF THE INVENTION

The present invention is directed to aqueous passivation compositions comprising ascorbic acid. More particularly, the invention is directed to aqueous passivation compositions that are characterized by comprising ascorbic acid, a film forming polymer and a trivalent chromium compound.

BACKGROUND OF THE INVENTION

The coating or plating of base metal substrates with a metal, such as zinc, in order to provide both a decorative finish and/or corrosion protection to that base metal substrate, is long established in the art. The standards of quality control for coated and plated substrates can, of course, be demanding and consumers will therefore closely scrutinize the finish and appearance of the treated surface. Having regard to protective coatings based on zinc and zinc alloys, a surface condition known as "wet storage stain" can be unsightly and can impair the further painting or coating of the substrate. This stain, which is also known as "white rust" or "black rust" (for Galvalume® coatings) is attributable to the formation of zinc oxide and zinc hydroxide and develops upon exposure of the deposited zinc or zinc alloy to atmospheric oxygen and moisture.

Techniques to obviate wet storage stain on newly galvanized substrates are known and include inter alia: the application of duplex or powder coatings; the application of waxes and oil, particularly for base metal substrates in the forms of sheets, beams and wires; and, passivation treatments. The present invention is concerned with the treatment of zinc coatings or platings with passivation compositions which, in addition to providing corrosion resistance, can provide a variety of color coatings—including blue, yellow, olive or black—and an effective base for subsequent dyeing and coating operations.

Prior art passivation compositions have predominantly been based upon acidic aqueous solutions of chromate salts. Upon applying an acidic chromate passivation solution to a zinc coated or plated substrate, surface zinc atoms are oxidized to form, in effect, an interfacial layer of hydrated basic chromium chromate ($Cr_2O_3CrO_3 \cdot xH_2O$) and hydrous oxides of both chromium and zinc. As the acid is consumed in the oxidation reaction, however, the pH at the surface-liquid interface increases: this diminishes the combining power of chromium in the aqueous phase and leads to the precipitation of a thin gelatinous film comprising chromium hydroxide and complexes of chromium ions and zinc. This film builds up until acid protons can no longer contact the zinc metal and the surface redox reactions are thereby stopped: the resulting gel-like film may then be permitted to harden.

Traditionally, hexavalent chromium ($Cr^{6+}$ or chromium (VI)) was used in passivation compositions to supply the chromium present in the passivation film or conversion coating. However, the toxicological properties of chromium (VI) are problematic and the use of chromium(VI)-containing passivation treatments has also been strongly limited by inter alia EC directive 2000/53/EC. Consequently, there has been some focus in the art on the treatment of zinc surfaces with passivation compositions in which the chromium is at least partly in the trivalent state: mention in this regard may be made of the timeworn disclosures of: U.S. Pat. Nos. 2,559,878; 3,932,198; 3,647,569; 3,501,352; 4,359,345; 4,359,346; 4,359,347; 4,359,348; 4,349,392; 4,367,099; German Patent No. DE 2526832; and, UK Patent No. GB 1,461,244. The Cr(III), as used in these citations, is not toxic and the concomitant waste removal of Cr(III) is not as expensive as that of hexavalent chromium.

Chromium (III) passivate compositions as described in the aforementioned patents nearly invariably employ peroxide-type oxidizing agents, such as $H_2O_2$, a necessary bath constituents. These and like oxidizing agents, such as persulphates, can promote some conversion of trivalent chromium to hexavalent chromium during the formation of the conversion coating. A further problem associated therewith is the high rate of consumption and loss of the peroxide or persulphate oxidizing agent which necessitates their frequent replenishment and moreover a careful control of the pH of the composition to obviate concomitant rise in pH. The consumption of peroxide (and persulphate) compounds is due in part to the presence of various activating metal ions—present in the solution as additives or contaminants—which tend to catalyze decomposition of the oxidizing agent. The frequent replenishment of the peroxide and persulphate compounds represents an economic and energetic cost to the performance of the passivation or conversion process.

Certainly, passivation compositions based on chromate (III) which do not employ peroxide or persulphate-type oxidizing agents are known in the art. For example, U.S. Pat. No. 4,578,122 A (Crotty) describes an aqueous acidic peroxide-free solution which is utilized in a process for treating receptive metal surfaces to impart a chromium passivate film thereon. The described aqueous solution contains: chromium ions, substantially all of which are present in the trivalent state; hydrogen ions to provide a pH of about 1.2 to about 2.5; at least one additional metal ion selected from the group consisting of iron, cobalt, nickel, molybdenum, manganese, lanthanum, cerium and lanthanide, said ion(s) being present in an amount effective to activate the formation of the chromate passivate film; and, nitrate ions as the essential oxidizing agent, said nitrate ions being present in an amount to provide a molar ratio of nitrate ions to the sum of chromium ions and activating metal ions of at least 4:1. The amount of nitrate ions should further be sufficient to activate the hydrated trivalent chromium to form a chromate film on the substrate. The aqueous acidic solution can optionally further contain controlled amounts of: sulfate ions; halide ions; organic carboxylic acids; a bath soluble and compatible silicate compound; and, at least one wetting agent.

The presence of nitrate salts in the composition of U.S. Pat. No. 4,578,122 is considered highly disadvantageous. Such salts are converted to $NO_x$ during the spontaneous decomposition or the intended oxidation activity, and this $NO_x$ diffuses into the atmosphere as a pollutant.

It is further considered that low pH passivation compositions can also be deleterious in certain applications. In particular, low pH is considered to destabilize—through particle aggregation—any aqueous polymeric lactices included within the composition as film-forming components. Further, low pH passivation compositions can promote significant etching of the substrate surface and can provide an unstable passivation bath.

There consequently remains a need in the art to develop less acidic passivation compositions comprising a film-forming component, which compositions have particular applicability to steel surfaces coated with zinc or zinc alloys—and in which the levels of compounds such as chromate (VI) salts, peroxides, persulphates and nitrate salts can be minimized but wherein the reduction of such compounds in such developed compositions is not compensated by a decline in the performance of the compositions.

STATEMENT OF THE INVENTION

In accordance with a first aspect of the invention, there is provided an aqueous passivation composition for the treatment of zinc or zinc alloy coatings, said composition having a pH of from 6.5 to 9 and comprising, based on the weight of the composition:

- from 5 to 60 wt. % of a) at least one base polymer selected from acrylic polymers and non-ionic polyurethane polymers;
- from 0.1 to 2.5 wt. % of b) trivalent Cr(III) ions, calculated as Cr;
- c) ascorbic acid;
- from 0.1 to 2.5 wt. % of d) at least one aluminum compound selected from the group consisting of: aluminum hydroxide; aluminum metahydroxide; aluminum trichloride; aluminum alcoholates; aluminum glycolates; aluminum tris(β-ketones); aluminum tris(β-ketoesters); aluminum soaps; and, aluminum carboxylates; and,
- up to 10 wt. % of e) at least one finely divided wax,
- wherein said composition is characterized in that it is substantially free of nitrate anions and is substantially free of hexavalent chromium (Cr(VI). The composition is preferably further characterized by being substantially free of peroxide and persulfate compounds.

There is, for example, provided an aqueous passivation composition for the treatment of zinc or zinc alloy coatings, said composition having a pH of from 7.0 to 8.5, preferably from 7.0 to 8.0 and said composition comprising, based on the weight of the composition:

- from 15 to 40 wt. %, preferably from 20 to 35 wt. % of a) said at least one base polymer selected from acrylic polymers and non-ionic polyurethane polymers;
- from 0.1 to 2.0 wt. %, preferably from 0.1 to 1.5 wt. % of b) said Cr (III) ions, calculated as Cr;
- from 0.1 to 1.0 wt. %, preferably from 0.1 to 0.5 wt.-% of c) ascorbic acid;
- from 0.1 to 2.0 wt. %, preferably from 0.2 to 1.0 wt. % of d) said at least one aluminum compound selected from the group consisting of: aluminum hydroxide; aluminum metahydroxide; aluminum trichloride; aluminum alcoholates; aluminum glycolates; aluminum tris(β-ketones); aluminum tris(β-ketoesters); aluminum soaps; and, aluminum carboxylates;
- from 1 to 8 wt. %, preferably from 1 to 5 wt. % of e) said wax; and,
- from 10 to 50 wt. %, preferably from 10 to 40 wt. % of water, wherein said composition is characterized in that it is substantially free of nitrate anions and is substantially free of hexavalent chromium (Cr(VI)).

The aforementioned trivalent chromium ions may be directly provided in the composition by a salt selected from the group consisting of: chromium sulfate ($Cr_2(SO_4)_3$); chromium alum ($KCr(SO_4)_2$); chromium chloride ($CrCl_3$); and, chromium bromide ($CrBr_3$); and, mixtures thereof.

Alternatively or additionally, the trivalent chromium ions are obtained by reduction of chromium (VI) provided as one or more hexavalent chromium compounds: the composition will then comprise at least one reducing agent in an amount sufficient to ensure complete reduction of the hexavalent chromium to trivalent chromium. The source of hexavalent chromium ions (Cr(VI)) may in certain embodiments be selected from the group consisting of: chromium trioxide ($CrO_3$); lithium chromate ($Li_2CrO_4$); lithium dichromate ($Li_2Cr_2O_7$); sodium chromate ($Na_2CrO_4$); sodium dichromate ($Na_2Cr_2O_7$); potassium chromate ($K_2CrO_4$); potassium dichromate ($K_2Cr_2O_7$); ammonium chromate ($(NH_4)_2CrO_4$) ammonium dichromate ($(NH_4)_2Cr_2O_7$); magnesium chromate ($MgCrO_4$); magnesium dichromate ($MgCr_2O_7$); calcium chromate ($CaCrO_4$); calcium dichromate ($CaCr_2O_7$); zinc chromate ($ZnCrO_4$); zinc dichromate ($ZnCr_2O_7$); and, mixtures thereof. In this embodiment, ascorbic acid should be included in the composition to allow full conversion to trivalent Cr(III) and should preferably be included in an amount such that the molar ratio of ascorbic acid : Chromium is from 1:3 to 4:5.

It is preferred that d) said at least one aluminum compound is selected from aluminum tricarboxylates ($Al(OOCR)_3$), monohydroxy aluminum dicarboxylates ($(RCOO)_2Al(OH)$ and dihydroxy aluminum monocarboxylates, ($RCOOAl(OH)_2$), wherein R is a $C_1$-$C_8$ alkyl group.

In an important embodiment, the passivation composition as defined herein above and in the appended claims, is obtainable through: mixing a portion comprising hexavalent chromium as component b) dissolved in water with a molar excess of ascorbic acid according to component c), preferably wherein the molar ratio of ascorbic acid to chromium is in the range from 1:3 to 4:5; and thereafter; adding the components a), d) and e) to said mixture.

In accordance with a second aspect of the invention, there is provided a process for imparting a chromate passivate film to a substrate to which a zinc or zinc alloy coating has been applied to at least one surface thereof, said process comprising contacting said at least one coated surface of the substrate with an aqueous composition as defined herein above and in the appended claims at a temperature ranging from 20° C. to 90° C. for a period of time sufficient to form a passivate film thereon.

In accordance with a third aspect of the invention, there is provided a passivated substrate obtained by the process defined herein above and in the appended claims. The passivated substrate has been demonstrated to provide efficacious resistance to corrosion.

Definitions

As used herein, the singular forms "a", "an" and "the" include plural referents unless the context clearly dictates otherwise.

The terms "comprising", "comprises" and "comprised of" as used herein are synonymous with "including", "includes", "containing" or "contains", and are inclusive or open-ended and do not exclude additional, non-recited members, elements or method steps. If used, the phrase "consisting of" is closed, and excludes all additional elements. Further, the phrase "consisting essentially of" excludes additional material elements, but allows the inclusions of non-material elements that do not substantially change the nature of the invention.

When amounts, concentrations, dimensions and other parameters are expressed in the form of a range, a preferable range, an upper limit value, a lower limit value or preferable upper and limit values, it should be understood that any ranges obtainable by combining any upper limit or preferable value with any lower limit or preferable value are also specifically disclosed, irrespective of whether the obtained ranges are clearly mentioned in the context.

The words "preferable", "preferred", "preferably", "particularly" and "desirably" are used frequently herein to refer to embodiments of the disclosure that may afford particular benefits, under certain circumstances. However, the recitation of one or more preferable, preferred, particular or desirable embodiments does not imply that other embodiments are not useful and is not intended to exclude those other embodiments from the scope of the disclosure.

As used throughout this application, the word "may" is used in a permissive sense—that is meaning to have the potential to—rather than in the mandatory sense.

As used herein, room temperature is 23° C. plus or minus 2° C.

As used herein, number average molecular weight (Mn) and weight average molecular weight (Mw) are determined by gel permeation chromatography (GPC) with tetrahydrofuran (THF) as the eluent in accordance with DIN 55672-1:2007-08. The term polydispersity (PD) is derived from Mw and Mn and is calculated as (Mw/Mn).

Where stated, the hydroxyl number is analyzed in accordance with according to the standard test method ASTM D4274-11.

Viscosities of the composition compositions may be determined using the Brookfield Viscometer, Model RVT at standard conditions of 20° C. and 50% Relative Humidity (RH). The viscometer is calibrated using silicone oils of known viscosities, which vary from 5,000 cps to 50,000 cps. A set of RV spindles that attach to the viscometer are used for the calibration. Measurements of the passivation compositions are done using the No. 6 spindle at a speed of 20 revolutions per minute for 1 minute until the viscometer equilibrates. The viscosity corresponding to the equilibrium reading is then calculated using the calibration.

As used herein, the "glass transition temperature" (Tg) is determined by differential scanning calorimetry (DSC) employing a 20 K/min ramp rate and midpoint measurement in accordance with DIN 53 765.

As used herein, by "$d_{50}$ particle size" is meant that the particle size distribution is such that at least 50% of the particles by weight have a particle size diameter of less than the specified value. Unless otherwise stated, that particle size is determined by laser diffraction.

As defined herein, the term "conversion coating" or "conversion treatment," refers to a treatment of the surface of a substrate which causes the surface material to be chemically converted to a different material.

The term "passivation" refers to a treatment of the surface of a substrate to form a barrier layer to corrosive conditions on said surface but without a cohesive film forming a chemical bond between the surface and the passivation layer. The term "passivation composition" as used herein refers to that composition which actually contacts the zinc coated or zinc-alloy coated substrate. As is known in the art, such contacting occurs in a so-called "bath" which is shaped, sized and disposed to enable at least part of the substrate to be immersed therein. The passivation bath should moreover be sized to allow for movement of the composition around and throughout the loaded substrate, which movement can be further enhanced with recirculation and/or ultrasonics. The pH of the composition within the bath, the temperature of the bath, and contact time of the substrate are result effective variables which should be monitored either manually or automatically, whenever possible.

Unless otherwise stated, where a molar ratio is given herein with respect "to chromium", this refers to the total content of chromium in the composition, independent of the oxidation state(s) of that metal.

As used herein, the term "alloy" refers to a substance composed of two or more metals or of a metal and a non-metal which have been intimately united, usually by being fused together and dissolved in each other when molten. The term "zinc alloy" therefore denotes an alloy of which zinc metal is a constituent component, which zinc will generally comprise at least 40 wt. %—more typically at least 50 wt. % or at least 60 wt. %—of the alloy, on a metals basis. Metals which may be alloyed with zinc include, but are not limited to, aluminum, tin, nickel, titanium and cobalt. Herein, for a zinc/aluminum alloy, it is preferred that zinc constitutes, on a metals basis, at least 40 wt. % of the alloy and conversely that aluminum constitutes, on a metals basis, up to 60 wt. % of the alloy.

As used herein, "mineral acid" refers to an acid derived from one or more inorganic compounds. A mineral acid is not organic and all mineral acids release hydrogen ions when dissolved in water.

As used herein, "phosphoric acid" refers to ortho-phosphoric acid having the formula $H_3PO_4$, which acid is typically available as an aqueous solution having a concentration up to 75 wt. % $H_3PO_4$. As used herein "phosphonic acid" refers to the phosphorus oxoacid having the formula $H_3PO_3$ that consists of a single pentavalent phosphorus covalently bound via single bonds to a single hydrogen and two hydroxy groups and via a double bond to an oxygen.

As used herein, the term "α-hydroxycarboxylic acid" means a carboxylic acid having at least one hydroxyl functional group occupying an α-position on said acid (carbon adjacent to a carboxylic acid functional group). The presence of hydroxyl groups occupying positions in the molecule other than the α-position on said acid is not precluded. This α-hydroxycarboxylic acid is included in the present composition in the form of the free acid.

As used herein, the term "monomer" refers to a substance that can undergo a polymerization reaction to contribute constitutional units to the chemical structure of a polymer. The term "mono functional", as used herein, refers to the possession of one polymerizable moiety. The term "polyfunctionar", as used herein, refers to the possession of more than one polymerizable moiety.

The term "ethylenically unsaturated monomer" as used herein, refers to any monomer containing a terminal double bond capable of polymerization under normal conditions of free-radical addition polymerization.

As used herein, an "active hydrogen compound" is a compound that includes at least one hydrogen atom that may be readily dissociated in an aqueous environment. Preferably, the hydrogen atom is attached to a nitrogen atom, an oxygen atom, a phosphorous atom, or a sulfur atom.

A "non-ionic polyurethane" as used herein is one that does not contain a hydrophilic ionizable group.

As used herein, "(meth)acryl" is a shorthand term referring to "acryl" and/or "methacryr". Thus the term "(meth) acrylate" refers collectively to acrylate and methacrylate.

The term "hydrocarbyl group" is used herein in its ordinary sense, which is well-known to those skilled in the art.

As used herein, "$C_1$-$C_n$ alkyl" group refers to a monovalent group that contains 1 to n carbons atoms, that is a radical of an alkane and includes straight-chain and branched organic groups. As such, a "$C_1$-$C_{30}$ alkyl" group refers to a monovalent group that contains from 1 to 30 carbons atoms, that is a radical of an alkane and includes straight-chain and branched organic groups. Examples of alkyl groups include, but are not limited to: methyl; ethyl; propyl; isopropyl; n-butyl; isobutyl; sec-butyl; tert-butyl; n-pentyl; n-hexyl; n-heptyl; and, 2-ethylhexyl. In the present invention, such alkyl groups may be unsubstituted or may be substituted with one or more halogen. Where applicable, a preference for a given substituent will be noted in the specification. In general, where the condition "$C_1$-$C_{30}$ alkyl" is stated, a preference for alkyl groups containing from 1-18 carbon atoms ($C_1$-$C_{18}$ alkyl)—for example alkyl groups containing from 1 to 12 carbon atoms ($C_1$-$C_{12}$ alkyl) or from 1 to 6 carbon atoms ($C_1$-$C_6$ alkyl)—should be noted.

The term "$C_1$-$C_{18}$ hydroxyalkyl" as used herein refers to a HO-(alkyl) group having from 1 to 18 carbon atoms, where the point of attachment of the substituent is through the oxygen-atom and the alkyl group is as defined above.

An "alkoxy group" refers to a monovalent group represented by —OA where A is an alkyl group: non-limiting examples thereof are a methoxy group, an ethoxy group and an iso-propyloxy group. The term "$C_1$-$C_{18}$ alkoxyalkyl" as used herein refers to an alkyl group having an alkoxy substituent as defined above and wherein the moiety (alkyl-O-alkyl) comprises in total from 1 to 18 carbon atoms: such groups include methoxymethyl (—$CH_2OCH_3$), 2-methoxyethyl (—$CH_2CH_2OCH_3$) and 2-ethoxyethyl.

The term "$C_2$-$C_4$ alkylene" as used herein, is defined as saturated, divalent hydrocarbon radical having from 2 to 4 carbon atoms.

The term "$C_3$-$C_{30}$ cycloalkyl" is understood to mean a saturated, mono-, bi- or tricyclic hydrocarbon group having from 3 to 30 carbon atoms. In the present invention, such cycloalkyl groups may be unsubstituted or may be substituted with one or more halogen. In general, a preference for cycloalkyl groups containing from 3-18 carbon atoms ($C_3$-$C_{18}$ cycloalkyl groups) should be noted. Examples of cycloalkyl groups include: cyclopropyl; cyclobutyl; cyclopentyl; cyclohexyl; cycloheptyl; cyclooctyl; adamantane; and, norbornane.

As used herein, an "$C_6$-$C_{18}$ aryl" group used alone or as part of a larger moiety—as in "aralkyl group"—refers to monocyclic, bicyclic and tricyclic ring systems in which the monocyclic ring system is aromatic or at least one of the rings in a bicyclic or tricyclic ring system is aromatic. The bicyclic and tricyclic ring systems include benzofused 2-3 membered carbocyclic rings. In the present invention, such aryl groups may be unsubstituted or may be substituted with one or more halogen. Exemplary aryl groups include: phenyl; ($C_1$-$C_4$)alkylphenyl, such as tolyl and ethylphenyl; indenyl; naphthalenyl, tetrahydronaphthyl, tetrahydroindenyl; tetrahydroanthracenyl; and, anthracenyl. And a preference for phenyl groups may be noted.

As used herein, "$C_2$-$C_{20}$ alkenyl" refers to hydrocarbyl groups having from 2 to 20 carbon atoms and at least one unit of ethylenic unsaturation. The alkenyl group can be straight chained, branched or cyclic and may optionally be substituted with one or more halogen. The term "alkenyl" also encompasses radicals having "cis" and "trans" configurations, or alternatively, "E" and "Z" configurations, as appreciated by those of ordinary skill in the art. In general, however, a preference for unsubstituted alkenyl groups containing from 2 to 10 ($C_{2-10}$) or 2 to 6 ($C_{2-6}$) carbon atoms should be noted. Examples of said $C_2$-$C_6$ alkenyl groups include, but are not limited to: —CH═$CH_2$; —CH═$CHCH_3$; —$CH_2CH$═$CH_2$; —C(═$CH_2$)($CH_3$); —CH═$CHCH_2CH_3$; —$CH_2CH$═$CHCH_3$; —$CH_2CH_2CH$═$CH_2$; —CH═C($CH_3$)$_2$; —$CH_2C$(═$CH_2$)($CH_3$); —C(═$CH_2$)$CH_2CH_3$; —C($CH_3$)═$CHCH_3$; —C($CH_3$)CH═$CH_2$; —CH═$CHCH_2CH_2CH_3$; —$CH_2CH$═$CHCH_2CH_3$; —$CH_2CH_2CH$═$CHCH_3$; —$CH_2CH_2CH_2CH$═$CH_2$; —C(═$CH_2$)$CH_2CH_2CH_3$; —C($CH_3$)═$CHCH_2CH_3$; —CH($CH_3$)CH═CHCH; —CH($CH_3$)$CH_2CH$═$CH_2$; —$CH_2CH$═C($CH_3$)$_2$; 1-cyclopent-1-enyl; 1-cyclopent-2-enyl; 1-cyclopent-3-enyl; 1-cyclohex-1-enyl; 1-cyclohex-2-enyl; and, 1-cyclohexyl-3-enyl.

As used herein, "alkylaryl" refers to alkyl-substituted aryl groups and "substituted alkylaryl" refers to alkylaryl groups further bearing one or more substituents such as halo, nitro, cyano, amido, amino, sulfonyl, sulfinyl, sulfanyl, sulfoxy, urea, thiourea, sulfamoyl, sulfamide and hydroxy. Further, as used herein "aralkyl" means an alkyl group substituted with an aryl radical as defined above.

The term "hetero" as used herein refers to groups or moieties containing one or more heteroatoms, such as N, O, Si and S. Thus, for example "heterocyclic" refers to cyclic groups having, for example, N, O, Si or S as part of the ring structure. "Heteroalkyt", "heterocycloalkyt" and "heteroaryl" moieties are alkyl, cycloalkyl and aryl groups as defined hereinabove, respectively, containing N, O, Si or S as part of their structure.

The present compositions are defined herein as being "substantially free" of certain compounds, elements, ions or other like components. The term "substantially free" is intended to mean that the compound, element, ion or other like component is not deliberately added to the composition and is present, at most, in only trace amounts which will have no (adverse) effect on the desired properties of the coating. An exemplary trace amount is less than 1000 ppm by weight of the composition. The term "substantially free" encompasses those embodiments where the specified compound, element, ion, or other like component is completely absent from the composition or is not present in any amount measurable by techniques generally used in the art.

DETAILED DESCRIPTION OF THE INVENTION

A: Base Polymer

The composition of the present invention comprises from 5 to 60 wt. % of a) at least one base polymer selected from acrylic polymers and non-ionic polyurethane polymers. It is preferred that component a) constitutes from 15 to 40 wt. %, for example from 20 to 35 wt. % of the composition.

A1: Acrylic Emulsion Polymer

In an embodiment, one or more acrylic polymers may be included as the base polymer of the composition. It is preferred that the included acrylic polymers are characterized by at least one of: a glass transition temperature (Tg) of from -30° C. to 60° C.; and, a weight average molecular weight of from 50000 to 500000 daltons.

There is no particular intention to limit the constituent monomers from which the acrylic polymer(s) is derived. However, it is preferred that, based on the total weight of monomers, at least 70 wt. % and preferably at least 80 wt. %, of the monomers from which the polymer is derived are (meth) acrylate ester monomers. In particular, said (meth) acrylate ester monomers may be in accordance with the definitions a1) to a3) given herein below.

a1) Aliphatic and Cycloaliphatic (Meth)acrylate Monomers

In an embodiment, the polymer may comprise a1) at least one (meth)acrylate monomer represented by Formula I:

$$H_2C = CGCO_2R^1 \quad (I)$$

wherein: G is hydrogen, halogen or a $C_1$-$C_4$ alkyl group; and, $R_1$ is selected from: $C_1$-$C_{30}$ alkyl; $C_2$-$C_{30}$ heteroalkyl; $C_1$-$C_{18}$ hydroxyalkyl; $C_3$-$C_{30}$ cycloalkyl; $C_2$-$C_8$ heterocycloalkyl; $C_2$-$C_{20}$ alkenyl; and, $C_2$-$C_{12}$ alkynyl.

For example, $R^1$ may be selected from $C_1$-$C_{18}$ alkyl, $C_2$-$C_{18}$ heteroalkyl, $C_1$-$C_{18}$ hydroxyalkyl, $C_3$-$C_{18}$ cycloalkyl; $C_2$-$C_8$ heterocycloalkyl; $C_2$-$C_8$ alkenyl, and, $C_2$-$C_8$ alkynyl. Desirably, said monomer(s) a1) are characterized in that $R^1$ is selected from $C_1$-$C_{12}$ alkyl, $C_1$-$C_6$ hydroxylalkyl and $C_3$-$C_{12}$ cycloalkyl.

Examples of (meth)acrylate monomers a1) in accordance with Formula (I) include but are not limited to: methyl (meth)acrylate; ethyl (meth)acrylate; butyl (meth)acrylate; hexyl (meth)acrylate; 2-ethylhexyl (meth)acrylate; dodecyl (meth)acrylate; lauryl (meth)acrylate; cyclohexyl (meth) acrylate; isobornyl (meth)acrylate; 2-hydroxyethyl (meth) acrylate (HEMA); 2-hydroxypropyl (meth)acrylate; ethylene glycol monomethyl ether (meth)acrylate; ethylene glycol monoethyl ether (meth)acrylate; ethylene glycol monododecyl ether (meth)acrylate; diethylene glycol monomethyl ether (meth)crylate; trifluoroethyl (meth)acrylate; and, perfluorooctyl (meth)acrylate.

a2) Aromatic (Meth)Acrylate Monomers

In a further embodiment, which is not mutually exclusive of that given above, the polymer may comprise a2) at least one (meth)acrylate monomer represented by Formula II:

$$H_2C = CQCO_2R^2 \quad \text{(II)}$$

wherein: Q may be hydrogen, halogen or a $C_1$-$C_4$ alkyl group; and, $R^2$ may be selected from $C_6$-$C_{18}$ aryl, $C_1$-$C_9$ heteroaryl, $C_7$-$C_{18}$ alkaryl and $C_7$-$C_{18}$ aralkyl.

Exemplary (meth)acrylate monomers a2) in accordance with Formula (II)—which may be used alone or in combination—include but are not limited to: benzyl (meth)acrylate; phenoxyethyl (meth)acrylate; phenoxydiethylene glycol (meth)acrylate; phenoxypropyl (meth)acrylate; and, phenoxydipropylene glycol (meth)acrylate.

a3) (Meth)Acrylate-Functionalized Oligomer

In still further embodiment—which is again not intended to be mutually exclusive of the inclusion of aliphatic and cycloaliphatic monomers (a1) and aromatic monomers (a2)—the polymer may comprise a3) at least one (meth) acrylate-functionalized oligomer. Said oligomers may have one or more acrylate and/or methacrylate groups attached to the oligomeric backbone, which (meth)acrylate functional groups may be in a terminal position on the oligomer and/or may be distributed along the oligomeric backbone.

It is preferred that said at least one (meth)acrylate functionalized oligomers: i) have two or more (meth)acrylate functional groups per molecule; and/or, ii) have a weight average molecular weight (Mw) of from 300 to 1000 daltons.

Examples of such oligomers, which may be used alone or in combination, include but are not limited to: (meth) acrylate-functionalized urethane oligomers such as (meth) acrylate-functionalized polyester urethanes and (meth)acrylate-functionalized polyether urethanes; (meth)acrylate-functionalized polyepoxide resins; (meth)acrylate-functionalized polybutadienes; (meth)acrylic polyol (meth) acrylates; polyester (meth)acrylate oligomers; polyamide (meth)acrylate oligomers; and, polyether (meth)acrylate oligomers. Such (meth)acrylate-functionalized oligomers and their methods of preparation are disclosed in inter alia: U.S. Pat. Nos. 4,574,138; 4,439,600; 4,380,613; 4,309,526; 4,295,909; 4,018,851; 3,676,398; 3,770,602; 4,072,529; 4,511,732; 3,700,643; 4,133,723; 4,188,455; 4,206,025; 5,002,976. Of the aforementioned polyether (meth)acrylates oligomers, specific examples include but are not limited to: PEG 200 DMA (n≈4); PEG 400 DMA (n≈9); PEG 600 DMA (n≈14); and, PEG 800 DMA (n≈19), in which the assigned number (e.g., 400) represents the weight average molecular weight of the glycol portion of the molecule.

The present invention does not preclude the polymer a) being derived from ethylenically unsaturated non-ionic monomers not conforming to the definitions of a1), a2) and a3). Without intention to limit the present invention, such further ethylenically unsaturated non-ionic monomers may include: silicone (meth)acrylate monomers, such as those taught by and claimed in U.S. Pat. No. 5,605,999 (Chu); α,β-ethylenically unsaturated monocarboxylic acids containing 3 to 5 carbon atoms such as acrylic acid, methacrylic acid, crotonic acid; $C_1$-$C_{18}$ alkyl esters of crotonic acid; α,β-ethylenically unsaturated dicarboxylic acids containing from 4 to 6 carbon atoms and the anhydrides, monoesters, and diesters of those acids; vinyl esters such as vinyl acetate, vinyl propionate and monomers of the VEOVA™ series available from Shell Chemical Company; vinyl and vinylidene halides; vinyl ethers such as vinyl ethyl ether; vinyl ketones including alkyl vinyl ketones, cycloalkyl vinyl ketones, aryl vinyl ketones, arylalkyl vinyl ketones, and arylcycloalkyl vinyl ketones; aromatic or heterocyclic aliphatic vinyl compounds; poly(meth)acrylates of alkane polyols, such as ethylene glycol di(meth)acrylate, propylene glycol di(meth)acrylate, butylene glycol di(meth)acrylate, neopentyl glycol di(meth)acrylate, hexylene glycol di(meth) acrylate, trimethylolpropane tri(meth)acrylate, glycerin tri (meth)acrylate, and pentaerythritol tetra(meth)acrylate; poly (meth)acrylates of oxyalkane polyols such as diethylene glycol di(meth)acrylate, dipropylene glycol di(meth)acrylate, triethylene glycol di(meth)acrylate, tetraethylene glycol di(meth)acrylate, dibutylene glycol di(meth)acrylate, di(pentamethylene glycol)dimethacrylate; polyethylene glycol di(meth)acrylates; and, bisphenol-A di(meth)acrylates, such as ethoxylated bisphenol-A (meth)acrylate ("EBI-PMA").

Representative examples of other ethylenically unsaturated polymerizable non-ionic monomers include, without limitation: ethylene glycol dimethacrylate (EGDMA); fumaric, maleic, and itaconic anhydrides, monoesters and diesters with $C_1$-$C_4$ alcohols such as methanol, ethanol, propanol, isopropanol, butanol, isobutanol, and tert-butanol. Representative examples of vinyl monomers include, without limitation, such compounds as: vinyl acetate; vinyl propionate; vinyl ethers, such as vinyl ethyl ether; and, vinyl ethyl ketone. Representative examples of aromatic or heterocyclic aliphatic vinyl compounds include, without limitation, such compounds as styrene, α-methyl styrene, vinyl toluene, tert-butyl styrene, 2-vinyl pyrrolidone, 5-ethylidene-2-norbornene and 1-, 3-, and 4-vinylcyclohexene.

As is known in the art, the acrylic base polymer may be prepared from the starting monomers by an aqueous emulsion polymerization process in the presence of a water-soluble free-radical initiator and under appropriate heating. The polymerization medium may comprise water and water-miscible liquids, such as $C_1$-$C_4$ alkanols, but preferably consists only of water. The polymerization temperature may be in the range from 30° C. to 120° C., for example from 50°

C. to 100° C.: that temperature need not be held constant but may, for example, be raised during the emulsion polymerization.

Suitable free radical initiators, which are conventionally used in an amount between 0.05 and 5 wt. % based on the total weight of monomers used, include: hydrogen peroxide; alkyl hydroperoxides, such as t-butylhydroperoxide and cumene hydroperoxide; persulphates, such as $NH_4$-persulphate, K-persulphate and Na-persulphate; organic peroxides, such as acyl peroxides and including benzoyl peroxide; dialkyl peroxides, such as di-t-butyl peroxide; peroxy esters, such as t-butyl perbenzoate; and, azo-functional initiators, such as azo-bis(isobutyronitrile) (AIBN), 2,2'-azo-bis(2-methyl butane nitrile) (ANBN) and 4,4'-azobis(4-cyanovaleric acid).

The aforementioned peroxy initiator compounds may in some cases be advantageously used in combination with suitable reductors to form a redox system. As suitable reductors, there may be mentioned: sodium pyrosulphite; potassium pyrosulphite; sodium bisulphite; potassium bisulphate; acetone bisulfite; hydroxymethane sulfinic acid; and, isoascorbic acid. Metal compounds such as Fe.EDTA may also be usefully employed as part of the redox initiator system.

The person of skill in the art will be able to select an appropriate regimen for the addition of the initiator to the polymerization vessel in the course of the free radical aqueous emulsion polymerization. It can be introduced both completely into the polymerization vessel, or used continuously or in stages according to its consumption in the course of the free radical aqueous emulsion polymerization. Preferably, a part is initially charged and the remainder supplied according to the consumption of the polymerization.

The aqueous polymerization is typically performed in the presence of from 0.1 to 5.0 wt %, based on the total weight of monomers, of emulsifier. Preferably non-ionic emulsifiers are employed, optionally in combination with anionic emulsifiers. As suitable non-ionic emulsifiers there may be mentioned linear or branched polyoxyethylene alcohols having from 5 to 50 ethylene oxide (EO) units. As suitable anionic emulsifiers there may be mentioned $C_1$-$C_{18}$ alkane sulfates, $C_1$-$C_{18}$ alkane sulfonates and phosphate esters.

In the emulsion polymerization according to the invention, aqueous dispersions of the polymer are generally obtained with a solids content of greater than 60% by weight. Further, the acrylic emulsion polymer should be obtained with a mono-modal particle size distribution characterized in that the average particle size ($d_{50}$) of the polymer particles in the aqueous dispersion is from 50 to 400 nm, for example from 50 to 200 nm. The aqueous dispersions—as obtained—may be further processed or may be directly admixed with the further components to form the aqueous coating composition.

A2: Non-Ionic Polyurethane Emulsion Polymer

In the alternative, and as is known in the art, suitable non-ionic polyurethanes may be obtained from the reaction of: i) at least one polyol; ii) optionally further active hydrogen compounds; and, iii) at least one polyisocyanate compound. The equivalence ratio of the active hydrogen to NCO groups of the reactants should be selected to ensure that no free NCO groups are present: the equivalence ratio might therefore be at least 1:1 and preferably from 1:1 to 1.2:1.

As used herein, "polyol" refers to any compound comprising two or more hydroxyl groups: the term is thus intended to encompass diols, triols and compounds containing four or more —OH groups. Moreover, the at least one reactant polyol should herein be selected from the group consisting of: polyester polyols; polyether polyols; and, polycarbonate polyols. The polyol should preferably have a number average molecular weight (Mn) of from 1000 to 50,000 g/mol, for instance from 1000 to 25,000 g/mol. Alternatively or additionally to this molecular weight characterization, the hydroxyl number of the reactant polyol should preferably be from 20 to 850 mg KOH/g, for instance from 25 to 500 mg KOH/g.

Polycarbonate diols may be obtained by reacting carbonic acid derivatives with diols. Exemplary carbonic acid derivatives are diaryl carbonates including but not limited to diphenyl carbonate, di($C_1$-$C_6$)alkyl carbonates and phosgene. Exemplary diols include but are not limited to: ethylene glycol; 1,2-propanediol; 1,3-propanediol; 1,3-butanediol; 1,4-butanediol; 1,5-pentanediol; 1,6-hexanediol; cyclohexane dimethanol; diethylene glycol; dipropylene glycol; neopentyl glycol; and, mixtures thereof.

Polyester diols may be obtained by reacting diols with either aliphatic, aromatic or cycloaliphatic dicarboxylic acids or, in some circumstances, the corresponding anhydrides thereof: the reaction may optionally take place in the presence of an esterification catalyst. Examples of suitable dicarboxylic acids include but are not limited to: adipic acid; glutaric acid; pimelic acid; suberic acid; nonanedicarboxylic acid; decanedicarboxylic acid; succinic acid; maleic acid; sebacic acid; azelaic acid; terephthalic acid; isophthalic acid; o-phthalic acid; tetrahydrophthalic acid; hexahydrophthalic acid; trimellitic acid; and, 1,4-cyclohexanedicarboxylic acid. Examples of suitable anhydrides include succinic, o-phthalic and trimellitic anhydride. It is noted that various commercially available dimeric fatty acids in saturated (hydrogenated) or unsaturated form may also be used as the dicarboxylic acid. And examples of suitable diols for the preparation of the polyester diols are: ethanediol; di-, tri- or tetraethylene glycol; 1,2-propanediol; di-, tri-, tetrapropylene glycol; 1,3-propanediol; 1,4-butanediol; 1,3-butanediol; 2,3-butanediol; 1,6-hexanediol; 1,5-pentanediol; 2,2-dimethyl-1,3-propanediol (neopentylglycol); 1,4-dihydroxycyclohexane; 1,4-dimethylcyclohexane; 1,8-octanediol; 1,10-decanediol; 1,12-decanediol; 2,2,4- and/or 2,4,4-trimethyl-1,3-pentanediol; and, mixtures thereof.

Other useful polyester diols are those obtainable from diol initiated polymerization of hydroxycarboxylic acids containing from 2 to 12 carbon atoms or a lactone thereof. The hydroxycarboxylic acids may be saturated or unsaturated, linear or branched, of which example include: glycolic acid; lactic acid; 5-hydroxy valeric acid; 6-hydroxy caproic acid; ricinoleic acid; 12-hydroxy stearic acid; 12-hydroxydodecanoic acid; 5-hydroxydodecanoic acid; 5-hydroxydecanoic acid; and. 4-hydroxydecanoic acid. Examples of suitable lactones are β-propiolactone, δ-valerolactone, ($C_1$-$C_6$)alkyl—valerolactone, ϵ-caprolactone and ($C_1$-$C_6$)alkyl-ϵ-caprolactone.

The above aside, it is preferred that the polyol from which the polyurethane is derived is a polyether polyol, in particular a polyether polyol having a polydispersity (PD) of less than 2, preferably less than 1.5, and more preferably less than 1.3. For completeness, a "polyether" is understood for purpose of the present invention as a polymer whose repeating unit contains ether functionalities C—O—C in the main chain. Polymers having lateral ether groups, such as cellulose ethers, starch ethers, and vinyl ether polymers, as well as polyacetals, are therefore not covered by this definition. Desirably, the polyether polyol is a polyoxyalkylene and in particular a polyoxy($C_2$-$C_3$)alkylene.

As described in inter alia U.S. Pat. Nos. 3,905,929 and 3,920,598, the presence of polyoxy($C_2$-$C_3$)alkylene chains in the reactant polyol can act to internally stabilize the non-ionic polyurethane in aqueous dispersion. This can minimize or obviate the need to include emulsifiers within the dispersion to provide external stabilization of the non-ionic polyurethane.

It is noted that at least one monol can preferably be employed in synthesizing the non-ionic polyurethane as a further active hydrogen reactant ii). For example, a mono-functional hydrophilic polyoxyalkylene—such as polyoxyethylene or polyoxpropylene—can be incorporated into the polyurethane as a means of modifying the properties of the latex and improving its ease of emulsion formation. When present, the monol is present in an amount of from 0.1 to 5 wt. %, based on the weight of reactants i) to iii).

As used herein "polyisocyanate" means a compound comprising at least two —N═C═O functional groups, for example from 2 to 5 or from 2 to 4 —N═C═O functional groups. Suitable polyisocyanates include aliphatic, cycloaliphatic, aromatic and heterocyclic isocyanates, dimers and trimers thereof, and mixtures thereof.

Aliphatic and cycloaliphatic polyisocyanates can comprise from 6 to 100 carbon atoms linked in a straight chain or cyclized and having at least two isocyanate reactive groups. Examples of suitable aliphatic isocyanates include but are not limited to straight chain isocyanates such as ethylene diisocyanate, trimethylene diisocyanate, tetramethylene diisocyanate, 1,6-hexamethylene diisocyanate (HDI), octamethylene diisocyanate, nonamethylene diisocyanate, decamethylene diisocyanate, 1,6,11-undecanetriisocyanate, 1,3,6-hexamethylene triisocyanate, bis(isocyanatoethyl)-carbonate, and bis (isocyanatoethyl) ether. Exemplary cycloaliphatic polyisocyanates include, but are not limited to, dicyclohexylmethane 4,4'-diisocyanate ($H_{12}$MDI), 1-isocyanatomethyl-3-isocyanato-1,5,5-trimethyl-cyclohexane (isophorone diisocyanate, IPDI), cyclohexane 1,4-diisocyanate, hydrogenated xylylene diisocyanate ($H_6$XDI), 1-methyl-2,4-diisocyanato-cyclohexane, m- or p-tetramethylxylene diisocyanate (m-TMXDI, p-TMXDI) and dimer fatty acid diisocyanate.

The term "aromatic polyisocyanate" is used herein to describe organic isocyanates in which the isocyanate groups are directly attached to the ring(s) of a mono- or polynuclear aromatic hydrocarbon group. In turn the mono- or polynuclear aromatic hydrocarbon group means an essentially planar cyclic hydrocarbon moiety of conjugated double bonds, which may be a single ring or may include multiple condensed (fused) or covalently linked rings. The term aromatic also includes alkylaryl. Typically, the hydrocarbon (main) chain includes 5, 6, 7 or 8 main chain atoms in one cycle. Examples of such planar cyclic hydrocarbon moieties include, but are not limited to, cyclopentadienyl, phenyl, napthalenyl-, [10]annulenyl-(1,3,5,7,9-cyclodecapentaenyl-), [12]annulenyl-, [8]annulenyl-, phenalene (perinaphthene), 1,9-dihydropyrene, chrysene (1,2-benzophenanthrene). Examples of alkylaryl moieties are benzyl, phenethyl, 1-phenylpropyl, 2-phenylpropyl, 3-phenylpropyl, 1-naphthylpropyl, 2-naphthylpropyl, 3-naphthylpropyl and 3-naphthylbutyl.

Exemplary aromatic polyisocyanates include, but are not limited to: all isomers of toluene diisocyanate (TDI), either in the isomerically pure form or as a mixture of several isomers; naphthalene 1,5-diisocyanate; diphenylmethane 4,4'-diisocyanate (MDI); diphenylmethane 2,4'-diisocyanate and mixtures of diphenylmethane 4,4'-diisocyanate with the 2,4' isomer or mixtures thereof with oligomers of higher functionality (so-called crude MDI); xylylene diisocyanate (XDI); diphenyl-dimethylmethane 4,4'-diisocyanate; di- and tetraalkyl-diphenylmethane diisocyanates; dibenzyl 4,4'-diisocyanate; phenylene 1,3-diisocyanate; and, phenylene 1,4-diisocyanate.

The polyisocyanates, where required, may have been biuretized and/or isocyanurated by generally known methods, such as described in UK Patent No. 889,050. It is also noted that the term "polyisocyanate" is intended to encompass pre-polymers formed by the partial reaction of the aforementioned aliphatic, cycloaliphatic, aromatic and heterocyclic isocyanates with polyols to give isocyanate functional oligomers, which oligomers may be used alone or in combination with free isocyanate(s).

To facilitate their inclusion in the compositions of the present invention, the at least one non-ionic polyurethane may be initially provided as an aqueous dispersion, the particles of which dispersion may desirably be characterized by a mono-modal particle size distribution having a $d_{50}$ particle size of less than 1 micron, for instance of from 50 to 400 nm, as measured by dynamic light scattering.

The formation of a polyurethane dispersion in water may best be achieved through: i) the first formation of a pre-polymer having free NCO groups from the aforementioned reactants under anhydrous conditions or in the presence of an organic solvent; and, ii) the dispersion of the pre-polymer in the aqueous phase in either a continuous process of which high internal phase ratio (HIPR) process is an example or in a batch process of which an inverse phase process is an example. The reaction i) may be performed under catalysis and, for instance, at a temperature of from 25 to 100° C. The yielded pre-polymer should preferably be characterized by at least one of: i) an NCO content of from 5 to 30%, preferably from 10 to 25 wt. % based on the weight of the pre-polymer; ii) an NCO functionality of from 2.2 to 3.0, preferably from 2.2 or 2.4 to 2.9; iii) a viscosity at 20° C. of from 300 to 35,000 mPa·s, preferably from 1,000 to 10,000 mPa·s; and, iv) a number average molecular weight (Mn) of from 500 to 30,000, for example from 500 to 15,000 or from 500 to 10,000 g/mol. For completeness, these characterizations i) to iv) are not intended to be mutually exclusive: indeed, the pre-polymer may meet one, two, three or four of these stated characterizations.

Standard polyurethane catalysts known in the art include: stannous salts of carboxylic acids, such as stannous octoate, stannous oleate, stannous acetate and stannous laureate; dialkyltin dicarboxylates, such as dibutyltin dilaureate and dibutyltin diacetate; tertiary amines; alkanolamine compounds; 2,3-dimethyl-3,4,5,6-tetrahydropyrimidine; tetraalkylammonium hydroxides; alkali metal hydroxides; alkali metal alcoholates; tin alkoxides, such as dibutyltin dimethoxide, dibutyltin diphenoxide and dibutyltin diisoproxide; tin oxides, such as dibutyltin oxide and dioctyltin oxide; the reaction products of dibutyltin oxides and phthalic acid esters; tin mercaptides; alkyl titanates; organoaluminum compounds such as aluminum trisacetylacetonate, aluminum trisethylacetoacetate and diisopropoxyaluminum ethylacetoacetate; chelate compounds such as zirconium tetraacetylacetonate and titanium tetraacetylacetonate; organosilicon titanium compounds; bismuth tris-2-ethylhexanoate; acid compounds such as phosphoric acid and p-toluenesulfonic acid; triphenylborane; triphenylphosphine; 1,8-diazabicycloundec-7-ene (DBU); 1,5-diazabicyclo[4.3.0]non-5-ene; 1,4-diazabicyclo[2.2.2]octane; 4-dimethylaminopyridine; 1,5,7-triazabicyclo[4.4.0]dec-5-ene; 7-methyl-1,5,7-triazabicyclo[4.4.0]dec-5-ene; 1,8-bis(tetramethylguanidino)naphthalene; and, 2-tert-butyl-1,1,3,3-tetramethylguanidine. Depending on the nature of the isocyanate, the amount of catalyst employed is typically in the range from 0.005 to 10% by weight of the mixture catalyzed.

As noted, the pre-polymer can optionally be made in the presence of a solvent and the solvent removed at least in part and preferably wholly either before or after the production of the aqueous dispersion. When a solvent is used, examples of solvents which are not reactive with the isocyanate include: ketones such as acetone and butanone; ethers such as tetrahydrofuran, dioxane and dimethoxyethane; ether esters such as methoxypropyl acetate; (cyclic) amide and ureas such as dimethylformamide and dimethylacetamide; N,N'-dimethyl-2,5-dizapentanone; N-methylpyrrolidone; and, capped glycol ethers. Such solvents may be added at any stage of the pre-polymer preparation.

It is preferred the aforementioned pre-polymers are extended with a chain extender. As known to the skilled artisan, typical chain extenders have a weight average molecular weight (Mw) of from 18 to 500 g/mol and have at least two active hydrogen containing groups. In particular, polyamines and/or water may be used as chain extenders with the mixture of water and polyamines being particularly preferred. As exemplary polyamines which may be used alone or in combination there may be mentioned: aminated polypropylene glycols such as Jeffamine D-400, available from Huntsman Chemical Company; hydrazine; piperazine; amino ethyl piperazine; 2-methyl piperazine; 1,5-diamino-3-methyl-pentane; isophorone diamine; ethylene diamine; diamino butane; hexane diamine; hexamethylene diamine; tetramethylene tetraamine; aminoethyl propyl trimethoxy silane; diethylene triamine; triethylene tetramine; triethylene pentamine; ethanolamine; and, lysine.

Where a chain extender other than water—as the dispersion medium—is used in preparing the non-ionic polyurethane polymers of the present invention, the equivalence ratio of the active hydrogen provided by the chain extender to the NCO groups of the pre-polymer should be selected to ensure that no free NCO groups are present in the final polyurethane: an equivalence ratio might therefore be at least 1:1 and preferably from 1:1 to 1.2:1.

B: Trivalent Chromium

The composition of the present invention comprises from 0.1 to 2.5 wt. %, based on the weight of the composition of Cr(III) ions, calculated as Cr. Preferably the composition will comprise from 0.1 to 2.0 wt. %, for example from 0.1 to 1.5 wt. % of said Cr (III) ions.

The trivalent chromium ions can be directly introduced to the passivation composition in the form of a bath soluble and compatible chromium (III) compound: salts such as chromium sulfate ($Cr_2(SO_4)3$), chromealum (chromium potassium sulfate, $KCr(SO_4)_2$), chromium chloride ($CrCl_3$) and chromium bromide ($CrBr_3$) are particularly suitable for this purpose.

In a preferred alternative, chromium (III) ions are herein introduced into the composition by reduction of hexavalent chromium ions in the aqueous phase by ascorbic acid. Exemplary water soluble hexavalent chromium compounds, which may be used alone or in combination, include: chromium trioxide ($CrO_3$); lithium chromate ($Li_2CrO_4$); lithium dichromate ($Li_2Cr_2O_7$); sodium chromate ($Na_2CrO_4$); sodium dichromate ($Na_2Cr_2O_7$); potassium chromate ($K_2CrO_4$); potassium dichromate ($K_2Cr_2O_7$); ammonium chromate ($(NH_4)2CrO4$) ammonium dichromate ($(NH_4)_2Cr_2O_7$); magnesium chromate ($MgCrO_4$); magnesium dichromate ($MgCr_2O_7$); calcium chromate ($CaCrO_4$); calcium dichromate ($CaCr_2O_7$); zinc chromate ($ZnCrO_4$); and, zinc dichromate ($ZnCr_2O_7$). A preference for the use of chromium trioxide ($CrO_3$), sodium chromate ($Na_2CrO_4$), sodium dichromate ($Na_2Cr_2O_7$), potassium chromate ($K_2CrO_4$) and potassium dichromate ($K_2Cr_2O_7$) may be mentioned. Good results have, in particular, been obtained where chromium trioxide is employed: this compound may alternatively be known in the art as anhydrous chromic acid.

C: Ascorbic Acid

The term "ascorbic acid" as used herein is intended to encompass the enantiomeric forms of the compound and mixtures thereof. The composition of the present invention comprises ascorbic acid which is necessarily added to chromium (Cr) where it is required that all hexavalent chromium first introduced into the aqueous composition be converted to Cr (III). However, it is herein preferred for the appearance of the treated zinc or zinc alloy coated steel surfaces that the molar ratio of ascorbic acid : aluminum in the composition for treatment of zinc or zinc alloy coatings is not more than 1:1, more preferably not more than 1:2, especially preferred not more than 1:3, but preferably at least 1:10, more preferably at least 1:5, wherein the amount of aluminum is preferably sourced from d) the at least one aluminum compound of the composition according to the present invention and thus from component D as further specified below.

Consequently, the composition may, in certain embodiments, also be characterized by comprising from 0.1 to 1.0 wt. %, based on the weight of the composition of ascorbic acid. Preferably the composition will comprise from 0.1 to 0.5 wt. % of ascorbic acid.

For completeness, the present invention does not preclude the presence of inorganic reducing agents in the composition and indeed this may be useful to guarantee complete reduction of the added Cr(VI). Suitable inorganic reducing agents include but are not limited to: alkali metal iodides; tin (II) compounds, such as $SnSO_4$ and $SnCl_2 \cdot 2H_2O$; antimony (III) compounds; ferrous salts, such as ferrous sulphate heptahydrate (HH), ferrous sulphate monohydrate (MH) and ammonium ferrous sulphate; sulfur dioxide; and, alkali metal sulfites, bisulfites and metabisulfites.

D: Aluminum Compounds

The present composition comprises from 0.1 to 2.5 wt. %, based on the weight of the composition of at least one aluminum compound selected from the group consisting of: aluminum hydroxide; aluminum metahydroxide; aluminum trichloride; aluminum alcoholates (alkoxides); aluminum glycolates; aluminum tris(β-ketones); aluminum tris(β-ketoesters); aluminum soaps; and, aluminum carboxylates. It is preferred that the composition comprises from 0.1 to 2.0 wt. %, for example from 0.2 to 1.0 wt. % of said at least aluminum compound.

Exemplary alcohol compounds that can be used as the alcoholate ligand include: $C_1$-$C_8$ alkyl alcohols such as methanol, ethanol, propanol, isopropyl alcohol, butanol, sec-butyl alcohol, isobutyl alcohol, tert-butyl alcohol, pentyl alcohol, isopentyl alcohol, and tert-pentyl alcohol; and, $C_1$-$C_8$ ether alcohols, such as 2-methoxyethanol, 2-ethoxyethanol, 2-butoxyethanol, 2-(2-methoxyethoxy)ethanol, 2-methoxy-1-methylethanol, 2-methoxy-1,1-dimethylethanol, 2-ethoxy-1,1-dimethylethanol, 2-isopropoxy-1,1-dimethylethanol, 2-butoxy-1,1-dimethylethanol, 2-(2-methoxyethoxy)-1,1-dimethylethanol, 2-propoxy-1,1-diethylethanol, 2-sec-butoxy-1,1-diethylethanol, and 3-methoxy-1,1-dimethylpropanol.

Exemplary glycol compounds which may form the glycolate ligands are $C_2$-$C_8$ glcyol compounds including:1,2-ethanediol; 1,2-propanediol; 1 ,3-propanediol; 2,4-hexanediol, 2,2-dimethyl-1,3-propanediol; 2,2-diethyl-1,3-propanediol; 1,3-butanediol; 2,4-butanediol; 2,2-diethyl-1, 3-butanediol; 2-ethyl-2-butyl-1,3-propanediol; 2,4-pentanediol; 2-methyl-1,3-propanediol; 2-methyl-2,4-pentanediol; 2,4-hexanediol; and, 2,4-dimethyl-2,4-pentanediol.

As regards said aluminum tris(β-ketones), exemplary β-diketone compounds which may form the ligands include: $C_1$-$C_8$ alkyl-substituted β-ketones, such as acetylacetone, hexane-2,4-dione, 5-methylhexane-2,4-dione, heptane-2,4-dione, 2-methylheptane-3,5-dione and 2,6-dimethylheptane-3,5-dione; fluoroalkyl-substituted β-diketones, such as 1 ,1,1-trifluoropentane-2,4-dione, 1,1,1-trifluoro-5,5-dimethylhexane-2,4-dione, 1,1,1,5,5,5-hexafluoropentane-2,4-dione, and 1,3-diperfluorohexylpropane-1,3-dione; and, $C_1$-$C_8$ ether-substituted β-diketones, such as 1,1,5,5-tetramethyl-1-methoxyhexane-2,4-dione, 2,2,6,6-tetramethyl-1-methoxyheptane-3,5-dione and 2,2,6,6-tetramethyl-1-(2-methoxyethoxy)heptane-3,5-dione.

As regards said aluminum tris(β-ketoesters), suitable ligands include but are not limited to $C_1$-$C_8$ alkyl malonates and $C_1$-$C_8$ alkyl acetonates. Aluminum soaps include but are not limited to aluminum monolaurate, aluminum dilaurate, aluminum trilaurate, aluminum monomyristate, aluminum dimyristate, aluminum trimyristate, aluminum monopalmitate, aluminum diaplmitate, aluminum tripalmitate, aluminum monostearate, aluminum distearate and aluminum tristearate.

As suitable aluminum carboxylates there may be mentioned aluminum tricarboxylates ($Al(OOCR)_3$), monohydroxy (monobasic) aluminum dicarboxylates $(RCOO)_2Al(OH)$ and dihydroxy (dibasic) aluminum monocarboxylates, $(RCOOAl(OH)_2)$ in which R is a $C_1$-$C_8$ alkyl group. Specific but not limiting examples include: monobasic aluminum formate, dibasic aluminum formate, aluminum triformate, monobasic aluminum acetate, dibasic aluminum acetate, aluminum triacetate, monobasic aluminum propanoate, dibasic aluminum propanoate, aluminum tripropanoate and aluminum trioctanoate.

In a preferred embodiment, the passivation composition comprises from 0.1 to 2.5 wt. %, based on the weight of the composition, of at least one aluminum carboxylate selected from aluminum triformate, aluminum triacetate, aluminum tripropanoate and aluminum trioctanoate. A particular preference for aluminum triacetate may be mentioned.

E: Wax

The composition of the present invention comprises up to 10 wt. %, based on the weight of the composition, of at least one finely divided wax. For example, the composition may comprise from 1 to 8 wt. %, for example from 1 to 5 wt. % or from 2 to 5 wt. % of said wax, based on the weight of the composition.

The term "wax" is known to the person skilled in the art and reference may be made to the definition in *Ullmann's Encyclopedia of Industrial Chemistry,* 6th Edition, Electronic Release (1998). However, without intention to limit the present invention, exemplary waxes include: paraffin wax [CAS No. 8002-74-2]; polyethylene wax [CAS No. 9002-88-4]; polyethylene-polypropylene waxes; co-polymeric polyethylene waxes, for example copolymers of ethylene with at least one monomer selected from (meth)acrylic acid, maleic anhydride, vinyl acetate and vinyl alcohol, which copolymers are available under, for instance CAS Nos. 38531-18-9, 104912-80-3 and 219843-86-4; polybutene waxes; Fischer-Tropsch waxes; oxidized waxes, for example oxidized polyethylene wax [CAS No. 68441-17-8]; polar modified polypropylene waxes; microcrystalline waxes, for example microcrystalline paraffin waxes [CAS No. 63231-60-7]; montan wax and montan wax raffinates; montanic acids and salts and esters thereof; fatty acid amides such as erucamide [CAS No. 112-84-5], oleamide [CAS No. 301-02-0] and 1,2-ethylenebis(stearamide) [CAS No. 110-30-5]; and, carnauba wax.

It is preferred that any waxes included in the present composition meet at least one of the following conditions: i) an acid number of less than 200 mg KOH/g, preferably less than 100 mg KOH/g; ii) a melting point of from 40 to 200° C., preferably from 60 to 180° C.; and, iii) a number average molecular weight (Mn) of at least 200 g/mol, preferably at least 400 g/mol. For completeness, these conditions are not intended to be mutually exclusive: waxes may meet one, two or three of these conditions.

A particular preference may be noted for the use of at least one wax selected from polyethylene waxes, oxidized polyethylene waxes, polypropylene waxes, oxidized polypropylene waxes and co-polymeric waxes based on ethylene or propylene as the main monomers, wherein said at least one wax is further characterized by a number average molecular weight (Mn) of from 400 to 30 000 g/mol, preferably from 1000 to 25 000 g/mol.

To facilitate their inclusion in the compositions of the present invention, waxes may be provided: i) in finely divided powder form, in particular in a micronized form characterized by a $d_{50}$ particle size of less than 5 microns, as measured by laser diffraction; and/or; ii) as an aqueous dispersion, the particles of which dispersion may desirably be characterized by a $d_{50}$ particle size of less than 1 micron, for instance of from 20 to 500 nm, as measured by dynamic light scattering.

F: Adjunct Ingredients

The compositions of the present invention will typically further comprise adjunct materials, which are necessarily minor components but which can nevertheless impart improved properties to these compositions. The total amount of adjunct materials in the compositions will from 0 to 10 wt. %, and preferably from 0.1 to 10 wt. % or from 0.1 to 7.5 wt. %, based on the total weight of the composition. The desired viscosity of the compositions will usually be determinative of the total amount of adjunct materials added but the above recited pH of the passivation composition may be determinative of the added amount of adjunct acidic ingredients.

Included among such adjunct materials are: ammonia; mineral acids; divalent metals; water-soluble or water-dispersible fluoroacids or salts thereof; corrosion inhibitors, such as dialkylthioureas, cupric sulphate and copper sulphate; adhesion promoters; wetting agents; defoaming agents; sequestrants; lubricants; and, mixtures thereof. As further exemplary corrosion inhibitors mention may be made of the following commercial materials: the Rodine® series, available from JMN Specialties, Inc. and Henkel Corporation; the Dodicor® series, available from Clariant AG; and, the Armohib® series available from Akzo Nobel Surfactants LLC.

As noted, the composition of the present invention may optionally comprise ammonia ($NH_3$). Preferably the composition will comprise up to 2 wt. %, based on the weight of the composition, of ammonia, for example from 0.1 to 2 wt. % or from 0.2 to 1 wt. %. For completeness, the constituent weight of ammonia is calculated on the basis of $NH_3$. The ammonia will be present in the aqueous compositions of the present invention as an ammonia solution $NH_3$(aq) which encompasses weakly basic solutions of ammonia in water which may referred to in the art as ammonium hydroxide, ammonia water, ammonia liquor, aqua ammonia, aqueous ammonia, or simply ammonia. While the term "ammonium hydroxide" suggests a base with the composition $[NH_4^+][OH^-]$, it is virtually impossible to isolate samples of $NH_4OH$, insomuch as these ions do not comprise a significant fraction of the total amount of ammonia in an ammonia solution, except in the case of extremely dilute ammonia solutions.

As regards the optional inclusion of mineral acid(s), the use of nitric acid is not precluded but is not preferred; conversely, the addition of at least one of phosphoric acid, phosphonic acid, sulphurous acid, sulphuric acid, hydrochloric acid and hydrobromic acid is considered to be particularly suitable. A particular preference for the use of at least one of phosphoric acid, phosphonic acid, sulphurous acid and sulphuric acid may be mentioned.

The passivation composition may further contain at least one divalent metal cation ($M^{2+}$). In preferred embodiments, said at least one divalent metal cation (M) is selected from the group consisting of: $Mg^{2+}$; $Ca^{2+}$; $Mn^{2+}$; $Co^{2+}$; $Ni^{2+}$; $Sr^{2+}$; $Ba^{2+}$; and, $Zn^{2+}$. The foregoing metal ions or mixtures thereof are most conveniently introduced into the composition as metal oxides, metal hydroxides and/or soluble and compatible metal salts, including but not limited to sulfate and halide salts. The use of nitrate and fluoride salts for this purpose is not preferred, however.

In certain embodiments of the present invention, the passivation composition comprises magnesium ($Mg^{2+}$) and/or manganese ($Mn^{2+}$). This magnesium and manganese are desirably introduced into the aqueous passivation composition as one or more of: manganese chloride; manganese sulphate; magnesium oxide, magnesium hydroxide; magnesium sulphate; and, magnesium chloride. A preference for magnesium oxide or magnesium hydroxide may be noted.

When present, the total amount of the divalent metal cations ($M^{2+}$) in the aqueous composition should not exceed 5 wt. % and preferably should not exceed 2.5 wt. %, based on the weight of the composition.

The passivation composition may optionally comprise at least one water-soluble or water-dispersible fluoroacid or a salt thereof, wherein said fluoroacid is defined by the following general empirical formula (II):

$$H_pT_qF_rO_s \tag{II}$$

wherein: each of q and r represents an integer from 1 to 10;
each of p and s represents an integer from 0 to 10; and,
T represents an element selected from the group consisting of Ti, Zr, Hf, Si, Sn, Al, Ge, and B.

Preferred fluoroacids of empirical formula (II) include compounds where: T is selected from Ti, Zr, or Si; p is 1 or 2; q is 1; r is 2, 3, 4, 5 or 6; and, s is 0, 1, or 2.

Exemplary fluoroacids used in the present invention may be selected from the group consisting of: fluorotitanic acid ($H_2TiF_6$); fluorozirconic acid ($H_2ZrF_6$); fluorosilicic acid ($H_2SiF_6$); fluoroboric acid ($HBF_4$); fluorostannic acid ($H_2SnF_6$); fluorogermanic acid ($H_2GeF_6$); fluorohafnic acid ($H_2HfF_6$); and, fluoroaluminic acid ($H_3AlF_6$). Preferred fluoroacids are: fluorotitanic acid ($H_2TiF_6$) and fluorozirconic acid ($H_2ZrF_6$).

Subject to the condition that the salt is water-soluble or water dispersible, one or more of the H atoms of the aforementioned fluoroacids may be replaced by suitable cations, such as ammonium, alkaline earth metal cations or alkali metal cations. The salts of alkali metal cations and ammonium are preferred in this context and mention may therefore be made of the following examples of suitable fluoroacid salts: $(NH_4)_2ZrF_6$; $H(NH_4)ZrF_6$; $(NH_4)_2TiF_6$; $H(NH_4)_2TiF_6$; $Na_2ZrF_6$; $K_2ZrF_6$; $Li_2ZrF_6$; $Na_2TiF_6$; $K_2TiF_6$; and, $Li_2TiF_6$.

Such salts may be added directly to the composition or may be produced in situ in the aqueous passivation composition by the partial or full neutralization of the acid fluoride or acid oxyfluoride with an appropriate base. It is noted that said base may be organic or inorganic in character: ammonium bicarbonate and hydroxylamine might be used, for instance.

When both fluoroacid and mineral acid are present, the fluoroacid or salt thereof is typically included in the composition such that the molar ratio of mineral acid to the metal (T) of said fluoroacid is in the range from 10:1 to 2:1, preferably from 9:1 to 3:1 and more preferably 8:1 to 4:1. When the level of mineral acid is outside the above ranges, the stability of the formulation is diminished: at lower levels of mineral acid within the stated ranges, the concomitant loss of stability of the formulation can be mitigated by increasing the amount of divalent metal cations in the composition. When the level of metal (T) falls below the stated molar ranges, the stability of the composition may be substantively affected but a decline in performance in the neutral salt spray (NSS) may be observed.

In an alternative but not mutually exclusive expression, the fluoroacid or salt thereof should be included in the passivation composition in an amount of from 1 to 5 wt. %, for example from 1 to 2.5 wt. %, based on the weight of the composition.

The presence of other complex fluoride anions in the passivation composition is not precluded and mention in this regard may be made of: fluoroindates (e.g. $InF_4^{-1}$); fluorophosphates (e.g. $PF_6^{-1}$); fluoroarsenates (e.g. $AsF_6^{-1}$); fluoroantimonates (e.g. $SbF_6^{-1}$); fluorobismuthates (e.g. $BiF_6^{-1}$); fluoro sulfates (e.g. $SF_6^{-2}$); fluoroselenates (e.g. $SeF_6^{-2}$); fluorotellurates (e.g. $TeF_6^{-2}$ or $TeOF_5^{-1}$); fluorocuprates (e.g. $CuF_3^{-1}$); fluoroargentates; fluorozincates (e.g., $ZnF_4^{-2}$); fluorovanadates (e.g. $VF_7^{-2}$); fluoroniobates (e.g. $NbF_7^{-2}$); fluorotantalates (e.g. $TaF_7^{-2}$); fluoromolybdates (e.g. $MoF_6^{-3}$); fluorotungstates (e.g. $WF_6^{-1}$); fluoroyttrates (e.g. $YF_6^{-3}$); fluorolanthanates (e.g. $LaF_6^{-3}$); fluorocerates (e.g. $CeF_6^{-3}$ or $CeF_6^{-2}$); fluoromanganates (e.g. $MnF_6^{-2}$); fluoroferrates (e.g. $FeF_6^{-3}$); fluoronickelates; and fluorocobaltates. Such anions may be included in the form of water-soluble or water dispersible salts, in particular the ammonium, alkaline earth metal or alkali metal salts. When present, said complex fluoride anions should be included in the composition in an amount up to 0.1 moles/litres, for example up to 0.05 moles/litre.

The presence in the passivation composition of free fluoride ions—not bound in complex form—is also not precluded as the fluoride anions can act as accelerators in the formation of passivation coatings and are present at the interface between the conversion coating and the metal matrix. Such free fluoride anions can be included through the addition to the passivation compositions of, for example: hydrofluoric acid; alkali metal fluorides, such as sodium fluoride; alkali metal hydrogen fluorides, such as sodium hydrogen fluoride; ammonium fluoride; and, ammonium hydrogen fluoride.

This aside, the presence of free fluoride ions—not bound in complex form—is not preferred. Despite the utility of the fluoride species in the passivation compositions, the environmental release of fluoride is problematic as documented in https://www.cdc.gov/niosh/. Thus, it is preferred that the passivation composition be substantially free of free fluoride anions.

The passivation composition may include up to 2.5 wt. %, for example from 0.1 to 2.5 wt. %, of non-ionic surfactants, based on the weight of the composition. Whilst other non-ionic surfactants may be have utility in the present invention, a particular preference for the use of fatty alcohol ethoxylates may be mentioned, of which examples include ethoxylated lauryl alcohol, stearyl alcohol, behenyl alcohol and oleyl cetyl alcohol.

Still further, the composition of the present invention may optionally comprise at least one α-hydroxycarboxylic acid represented by the general formula (III):

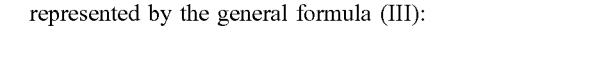

$$R_1CH(OH)COOH \quad (III)$$

wherein: $R_1$ represents a hydrogen atom, a $C_1$-$C_4$ alkyl group, a $C_2$-$C_6$ alkenyl group, a $C_1$-$C_6$ alkoxy group, a $C_3$-$C_6$ cycloalkyl group or a $C_6$-$C_{10}$ aryl group. Where applicable $R_1$ may optionally be substituted with one or more groups selected from: halogen; oxo; —OH; or, —COOH.

Suitable α-hydroxycarboxylic acids include but are not limited to: glycolic acid; lactic acid (2-hydroxypropanoic acid); 2-hydroxybutanoic acid; 2-hydroxypentanoic acid; 2-hydroxyhexanoic acid; glucuronic acid; citric acid; mandelic acid; galacturonic acid; ribonic acid (2,3,4,5-tetrahydroxypentanoic acid); gluconic acid (2S,3S,4R,5S)-2,3,4,5,6-pentahydroxyhexanoic acid; tartronic acid; tartaric acid; and, malic acid.

In an embodiment, said at least one α-hydroxycarboxylic acid is selected from the group consisting of: glycolic acid; gluconic acid; lactic acid (2-hydroxypropanoic acid); 2-hydroxybutanoic acid; 2-hydroxypentanoic acid; and, 2-hydroxyhexanoic acid. More particularly, the α-hydroxycarboxylic acid(s) of the coating composition should comprise or consist of gluconic acid.

For completeness, it is again noted that the above recited pH of the passivation composition is somewhat determinative of the added amount of such α-hydroxycarboxylic acid(s). When added within that pH constraint, the α-hydroxycarboxylic acid(s) should conventionally be included in the aqueous passivation composition in an amount up to 0.1 moles/litres, for example up to 0.05 moles/litre.

It is considered that the corrosion-protection performance of the disclosed passivation compositions—and resulting passivate films—can be enhanced by the incorporation of a transition metal salt and/or a transition metal complex therein. Considered particularly useful in this regard are the salts or complexes of transition metals selected from the group consisting of Ce, Ni, Co, V, Fe, Zn, Zr, Mn, Mo, W, Ti, Zr, Hf, Bi and the lanthanides.

Whilst said transition metals may be present in the complex fluoride anions mentioned hereinabove, such transition metals may alternatively or additionally be included in the composition as complexes with other ligands and/or as salts with further anions, provided said salts are at least partially soluble in water. As examples of anions, there may be mentioned: oxide; hydroxide; sulphate; chloride; iodide; citrate; lactate; succinate; formate; oxalate; malonate; and, acetate. As exemplary ligands for transition metal complexes, there may be mentioned: ethylenediaminetetraacetic acid (EDTA); diethylenetriaminepentaacetic acid (DTPA); hydroxyethylethylenediaminetriacetic acid (HEDTA); nitrilotriacetic acid (NTA); and, methylglycinediacetic acid (MGDA).

Preparation of the Passivation Compositions

The aqueous passivation compositions are formulated by simple mixing of the various components as well as any adjunct ingredients. Whilst the order of mixing of the components is not intended to be limited, it may be prudent to first form an aqueous dispersion of the base polymer and/or of the wax(es) before mixing said dispersion(s) and the further components. In this scenario, the aqueous dispersions of the acrylic polymer, of the non-ionic polyurethane and of the wax(es) may, for example, be prepared at a solids content of from 45 to 60 wt. %. Further, it may also be prudent to perform a preliminary step of admixing any hexavalent chromium (Cr(VI)) source—dissolved in water—with ascorbic acid: this precursor solution, containing Cr(III) ions obtained by reduction, may then be combined with further raw, dispersed or dissolved ingredients to form the final aqueous composition.

If necessary, the compositions may be prepared well in advance of its application. However, in an interesting alternative embodiment, a concentrated composition may first be obtained by mixing components with only a fraction of the water that would be present in the composition as applied: the concentrated composition may then be diluted with the remaining water shortly before its application. It is considered that such concentrated compositions may be prepared and stored as either single-package concentrates—that can be converted by dilution with water only—or as multi-part concentrates, two or more of which must be combined and diluted to form a complete working composition according to the invention. Any dilution can be effected simply by the addition of water, in particular deionized and/or demineralized water, under mixing. The composition might equally be prepared within a rinse stream whereby one or more streams of the concentrate(s) is injected into a continuous stream of water.

Without specific intention to limit the amount of water included in the passivation compositions, it is preferred that said compositions contain from 10 to 50 wt. %, preferably from 10 to 40 wt. % and more preferably from 20 to 40 wt. %, based on the weight of the composition, of water. In an alternative but not mutually exclusive characterization, the passivation composition may be defined by a viscosity of from 0.005 to 1 Pa·s (50 cps to 1000 cps), as measured using a Brookfield viscometer at 25° C.

Methods and Applications

Whilst the present invention is concerned with passivating of surfaces of zinc or zinc alloys, there is no intention to limit the base substrate to which that zinc or zinc alloy may have been applied nor the method of such application. As such, suitable base metal substrates may include but not be limited to iron, nickel, copper, aluminum and alloys thereof: substrates comprising or consisting of steel may be mentioned in particular. Such metal and alloy substrates may be provided in various forms, including sheets, plates, cuboids, spheres, annuli, solid cylinders, tubes and wires: the provision of substrates in more complex, shaped forms—obtained by conventional techniques such as bending, blanking, casting, forging, rolling and welding—is of course not precluded. Moreover, the plating or coating of zinc or zinc alloy may be applied to such base substrates by: electroplating; galvanizing, including hot-dip galvanizing and thermal diffusion galvanizing; and, galvannealing. By way of example only, the passivation compositions and methods of the present invention may have utility in the treatment of:

galvanized and galvanneal steel meeting the requirements of ASTM Designation A653; GALVALUME®, a 55% Al/43.4% Zn/1.6% Si alloy coated sheet steel available from Bethlehem Steel Corporation; and, GALFAN®, a 5% Al/95% Zn alloy coated sheet steel available from Weirton Steel Corporation.

In accordance with process aspects of the present invention, it is often advisable to remove foreign matter from the coated or plated metal substrate by cleaning and degreasing the relevant surfaces. Such treatments are known in the art and can be performed in a single or multi-stage manner constituted by, for instance, the use of one or more of: a waterborne alkaline degreasing bath; a waterborne cleaning emulsion; a cleaning solvent, such as carbon tetrachloride or trichloroethylene; and, a water rinse, preferably of deionized or demineralized water. In those instances where a waterborne alkaline degreasing bath is used, any of the degreasing agent remaining on the surface should desirably be removed by rinsing the substrate surface with deionized or demineralized water. Irrespective of the cleaning or degreasing agent applied, the so-treated substrate should not be subjected to an intermediate drying step prior to either the passivation treatment or to any subsequent pre-treatment step which precedes said passivation treatment.

As therefore intimated above, the present invention does not preclude the pre-treatment of the zinc or zinc alloy surface, independently of the performance of cleaning and/or degreasing steps. Such pre-treatments are known in the art and reference in this regard may be made to: German Patent Application No. DE 197 33 972 A1; German Patent Application No. DE 10 2010 001 686 A1; German Patent Application No. DE 10 2007 021 364 A1; and, US Patent Application Publication No. 2014/360630. In particular, the surface may be treated with a primer with the intention of facilitating the later adhesion of the passivate film.

After said cleaning, degreasing and/or pre-treatment steps, the passivation composition is applied to the substrate. The passivation composition may be applied at ambient temperature or the temperature of the passivation compositions may be elevated prior to application to, for instance, a temperature in the range from 30° C. to 90° C., for instance from 30° C. to 70° C.

To produce a double-face plated sheet, it is conventional commercially that an operating bath as hereinbefore described is prepared and the passivation composition is applied to the substrate by, without limitation, immersion, flooding, air-atomized spraying, air-assisted spraying, airless spraying, high-volume low-pressure spraying and air-assisted airless spraying. The minimum contact time of the composition with the substrate is most broadly that time which is sufficient to form the desired passivate film thereon: that contact time can be as little as 1 second or as great as 15 minutes in that instance where the passivation or conversion treatment is being performed on metal that will be cold worked: however, dependent upon the pH and the concentration of the applied solution, a contact time of from 5 to 300 seconds, for example from 5 to 50 seconds, would be more typical.

In certain circumstances it will only be necessary to form a passivate film on a single surface of the substrate. In the context of the present invention, the passivate film might only be applied to that plated surface of a steel substrate which is to form the inner side of the fuel tank, the side which contacts the fuel stored therein: forming passivate films on both the inner and outer surfaces of such a plated steel substrate may be deleterious to the subsequent weldability of that substrate. Techniques for applying the passivate composition to only a singular surface include but are not limited to: painting; brushing; roll coating; wiping; air-atomized spraying; air-assisted spraying; airless spraying; high-volume low-pressure spraying; and, air-assisted airless spraying.

At the conclusion of the application step, the article is dried using, for instance, ambient air drying, circulating warm air, forced air drying or infrared heating. The surface temperature of the substrate is controlled during drying: the peak metal temperature (PMT) need not exceed 100° C. and should, more particularly, be in the range from 20 to 90° C., for example 50 to 75° C.

Subsequent to drying, it is not precluded that the article be subjected to: at least one water rinse to remove residual passivation composition therefrom; and/or, rinsing with a dilute silicate solution based. The rinsed substrate may be dried after completion of the rinsing step(s) or, if applicable, after each rinse solution.

The above described treatment should desirably yield a protective passivate monolayer over the zinc or zinc alloy, which monolayer has a film weight of from 25 to 500 $mg/m^2$, preferably from 25 to 250 $mg/m^2$ or from 25 to 100 $mg/m^2$. If the film weight is less than 25 $mg/m^2$, the passivate film may impart insufficient corrosion resistance. If the film weight is larger than 500 $mg/m^2$, the adhesion of the passivate film to the surface will be insufficient, such that exfoliation of the coating may occur during further processing of the substrate.

The composition according to the present invention yields a passivate film that is either colorless, or blue or olive in color, with a flat to glossy finish. The exact nature of that finish is determined predominantly by the base substrate, the zinc or zinc alloy coating, and the immersion time in the conversion coating composition. Zinc or zinc alloy coatings passivated in accordance with the present invention exhibit corrosion protection for at least 250 hours before the observed onset of white rust corrosion, as defined by ASTM B-201. Alternatively or additionally, said zinc or zinc alloy coatings passivated in accordance with the present invention exhibit corrosion protection for at least 250 hours before the observed onset of white rust corrosion (as defined by ASTM B-201) when treated with neutral salt spray (NSS, 5 wt. % NaCl, 95 wt. % $H_2O$) under steady state conditions in accordance with the procedure of ASTM B-117.

The present invention does not preclude supplementary conversion coatings being applied to the passivate film obtained in accordance with the present invention; indeed such supplementary coatings may further extend corrosion protection of the finished article. Inorganic coatings based on silicates and organic conversion coatings based on epoxy resins might be mentioned as non-limiting examples of supplemental conversion coatings: reference in this regard may be made to inter alia U.S. Pat. No. 5,743,971 (Inoue) and U.S. Pat. No. 5,855,695 (McMillen). These supplemental conversion coatings may be applied by any suitable means known in the art, such as by dipping, spraying, roll-coating, electro-coating or powder coating.

Various features and embodiments of the disclosure are described in the following examples, which are intended to be representative and not limiting.

EXAMPLES

The following commercial and staple products are used in Example 1 which represents a composition in accordance with the present invention:

Ammonia Solution: 25% solution of ammonia in water

Acrylic Emulsion: Acrystar HP Cresta available from EOC Tailor Made Polymers India Ltd.

Wetting/Coupling agents: Rhodoline WA 40, available from Solvay Group

Polyethylene Wax: Aquaslip 671, available from The Lubrizol Corporation

Antiblocking agents: BYK 331, available from BYK Altana Group

Defoaming agent: Timet W 288S

An aqueous passivation composition was prepared by mixing the ingredients given in Table 1 herein below:

TABLE 1

| Ingredient | Example 1 (wt. %, based on weight of composition) |
|---|---|
| Water | 30.04 |
| $CrO_3$ | 0.86 |
| Ascorbic Acid | 0.75 |
| Aluminum Acetate | 0.5 |
| Ammonia Solution (25% by weight $NH_3$) | 0.75 |
| Acrylic Emulsion | 62.00 |
| Wetting/Coupling Agents | 0.60 |
| Polyethylene Wax | 4.00 |
| Antiblocking Agents | 0.30 |
| Defoaming Agents | 0.20 |

In addition, as a comparative example, the commercial formulation AQUALAC™ 3732 available from GTZ India Private Ltd. was provided. This composition is based on chromium (III) compounds and a styrene acrylate copolymer aqueous emulsion: this commercial formulation does not contain ascorbic acid.

Standard Test Panel Preparation: Specimens of Advanced Coating Technology (ACT) G-90 hot dipped galvanized steel were mechanically cut into squares of 4 cm×4 cm dimensions. Each obtained panel was treated with an alkaline cleaner at 55° C. for 10 seconds, rinsed with tap water at room temperature and then dried by squeegeeing. Each passivation composition selected for evaluation was applied to one surface of the panels by roller coater: nine panels were prepared from the aqueous passivation composition according to the present invention; and, quadruplicate panels were prepared for each reference passivation composition. The resultant coated test panels were then baked to the peak metal temperature (PMT) given in Table 2 herein below. The obtained coating weight of the test panels was determined on a metals basis and is also given in Table 2.

Based on these tabulated aqueous compositions, the following tests were performed utilizing both the aqueous passivation composition of the present invention and the reference composition.

Friction Coefficient Testing: Where applicable this parameter was tested for (coated) panels in accordance with ASTM G115 *Standard Guide for Measuring and Reporting Friction Coefficients*. The uncoated steel G-90 hot dipped galvanized steel (μ) panels had a friction coefficient of 0.35 to 0.4.

Neutral salt spray (NSS): This test was carried out according to ASTM B117 with a 5% NaCl solution at 35° C. (https://www.astm.org/Standards/B117). The coated panels were disposed in the spray chamber (ERICHSEN Model 606/400 L) at 15-30° from the vertical for 96 hours and, where applicable, for 500 hours. The test panels were not allowed to contact other surfaces in the chamber and condensed or corrosion products on their surfaces were not permitted to cross-contaminate each other. Photographic recording of the test panels was performed each 24 hours. After exposure, test panels were rinsed in deionized water to remove salt deposits from their surface and then immediately dried. A visual inspection of the coated panels was undertaken after 500 hours:

TABLE 2

| Test | Comparative Example | Example 1 |
|---|---|---|
| Appearance | Green to bluish colored liquid | Green to bluish colored liquid |
| pH | 6.3 | 7.5 |
| Solids Content (%) | 35.0 | 29.5 |
| Specific Gravity (23° C.) | 1.06 | 1.03 |
| Peak Metal Temperature (° C.) | 80-85 | 80-85 |
| Coefficient of Friction (μ) | 0.11 | 0.11 |
| Total Coating Weight ($gm^{-2}$ per side) | 1.5-1.8 | 1.5-1.8 |
| NSS (96 hours) | Some white rust and observed spotting | No white rust, no observed spotting |
| NSS (500 hours) | Discontinued | Less than 5% rust by area |

In view of the foregoing description and examples, it will be apparent to those skilled in the art that equivalent modifications thereof can be made without departing from the scope of the claims.

The invention claimed is:

1. An aqueous passivation composition for the treatment of zinc or zinc alloy coatings, the aqueous passivation composition comprising, based on the weight of the composition:

from 5 to 60 wt. % of a) at least one base polymer selected from acrylic polymers and non-ionic polyurethane polymers;

from 0.1 to 2.5 wt. % of b) trivalent Cr (III) ions, calculated as Cr;

c) ascorbic acid;

from 0.1 to 2.5 wt. % of d) at least one aluminum compound selected from the group consisting of: aluminum hydroxide; aluminum metahydroxide; aluminum trichloride; aluminum alcoholates; aluminum glycolates; aluminum tris (β-ketones); aluminum tris (β-ketoesters); aluminum soaps; and aluminum carboxylates; and, e) at least one finely divided wax present in the aqueous passivation composition in an amount of up to 10 wt. %;

wherein the aqueous passivation composition has a pH of from 6.5 to 9 and is substantially free of nitrate anions and is substantially free of hexavalent chromium (Cr(VI)).

2. The aqueous passivation composition according to claim 1, the aqueous passivation composition having a pH of from 7.0 to 8.5, and comprising, based on the weight of the composition:

from 15 to 40 wt. % of a);

from 0.1 to 2.0 wt. % of b);

from 0.1 to 1.0 wt. % of c);

from 0.1 to 2.0 wt. % of d) said at least one aluminum compound comprises aluminum carboxylates;

from 1 to 8 wt. % of e); and, from 10 to 50 wt. % of water;

wherein the aqueous passivation composition is free of hexavalent chromium (Cr(VI)).

3. The aqueous passivation composition according to claim 1, wherein a) the at least one base polymer comprises acrylic polymer having:

a glass transition temperature of from −30° C. to 60° C.; and/or, a weight average molecular weight (Mw) of from 50000 to 500000 Daltons.

4. The aqueous passivation composition according to claim 1, wherein a) the at least one base polymer is dispersed in the aqueous passivation composition and has a monomodal particle size distribution; and an average particle size ($d_{50}$) of the polymer particles in the aqueous dispersion is from 50 to 400 nm.

5. The aqueous passivation composition according to claim 1, wherein b) said chromium (III) ions are obtained by reduction of chromium (VI) provided as one or more hexavalent chromium compounds.

6. The aqueous passivation composition according to claim 5, wherein the hexavalent chromium compound is selected from the group consisting of: chromium trioxide ($CrO_3$); lithium chromate ($Li_2CrO_4$); lithium dichromate ($Li_2Cr_2O_7$); sodium chromate ($Na_2CrO_4$); sodium dichromate ($Na_2Cr_2O_7$); potassium chromate ($K_2CrO_4$); potassium dichromate ($K_2Cr_2O_7$); ammonium chromate ($(NH_4)_2CrO_4$) ammonium dichromate ($(NH_4)_2Cr_2O_7$); magnesium chromate ($MgCrO_4$); magnesium dichromate ($MgCr_2O_7$); calcium chromate ($CaCrO_4$); calcium dichromate ($CaCr_2O_7$); zinc chromate ($ZnCrO_4$); zinc dichromate ($ZnCr_2O_7$); and, mixtures thereof.

7. The aqueous passivation composition according to claim 6, wherein the hexavalent chromium compound is selected from the group consisting of: chromium trioxide ($CrO_3$); sodium chromate ($Na_2CrO_4$); sodium dichromate ($Na_2Cr_2O_7$); potassium chromate ($K_2CrO_4$); potassium dichromate ($K_2Cr_2O_7$); and, mixtures thereof.

8. The aqueous passivation composition according to claim 1, wherein the molar ratio of ascorbic acid: aluminum is not more than 1:1.

9. The aqueous passivation composition according to claim 1, wherein d) said at least one aluminum compound is selected from aluminum tricarboxylates ($Al(OOCR)_3$), monohydroxy aluminum dicarboxylates $(RCOO)_2Al(OH)$ and dihydroxy aluminum monocarboxylates, $(RCOOAl(OH)_2)$, wherein R is a $C_1$-$C_8$ alkyl group.

10. The aqueous passivation composition according to claim 1, wherein e) the at least one finely divided wax meets at least one of the following conditions:

an acid number of less than 200 mg KOH/g;

a melting point of from 40 to 200° C.; and, a number average molecular weight (Mn) of at least 200 g/mol.

11. The aqueous passivation composition according to claim 1, wherein e) the at least one finely divided wax is provided either in a micronized form having a $d_{50}$ particle size of less than 5 microns, as measured by laser diffraction, or as an aqueous dispersion, the particles of said aqueous dispersion having a $d_{50}$ particle size of less than 1 micron as measured by dynamic light scattering.

12. The aqueous passivation composition according to claim 1, wherein the aqueous passivation composition is substantially free of peroxide and persulfate compounds.

13. The aqueous passivation composition according to claim 1 obtainable through:

mixing a portion comprising hexavalent chromium dissolved in water with ascorbic acid according to component c) in a molar ratio of ascorbic acid to chromium in a range from 1:3 to 4:5, forming a mixture comprising the trivalent chromium ions of b) by reduction of said hexavalent chromium; and thereafter, adding the components a), d) and e) to said mixture.

14. A process for imparting a chromate passivate film to a substrate having at least one surface coated with a zinc or zinc alloy coating, said process comprising contacting the at least one coated surface of the substrate with an aqueous passivation composition according to claim 1, at a temperature ranging from 20° C. to 90° C. for a period of time sufficient to form a passivate film thereon.

* * * * *